US010362875B2

(12) United States Patent
Grace

(10) Patent No.: US 10,362,875 B2
(45) Date of Patent: Jul. 30, 2019

(54) EASY FOLDING CROSS BRACE DESIGN

(71) Applicant: Daniel R. Grace, Old Saybrook, CT (US)

(72) Inventor: Daniel R. Grace, Old Saybrook, CT (US)

(73) Assignee: GCI OUTDOOR, INC., Higganum, CT (US)

( * ) Notice: Subject to any disclaimer, the term of this patent is extended or adjusted under 35 U.S.C. 154(b) by 0 days.

(21) Appl. No.: 16/199,900

(22) Filed: Nov. 26, 2018

(65) Prior Publication Data

US 2019/0090642 A1 Mar. 28, 2019

Related U.S. Application Data

(63) Continuation of application No. 15/792,020, filed on Oct. 24, 2017, now Pat. No. 10,143,309, which is a continuation of application No. 14/464,318, filed on Aug. 20, 2014, now Pat. No. 9,795,217.

(60) Provisional application No. 61/867,675, filed on Aug. 20, 2013.

(51) Int. Cl.

| | |
|---|---|
| ***A47C 4/28*** | (2006.01) |
| ***A47C 7/70*** | (2006.01) |
| ***A47C 7/62*** | (2006.01) |

(52) U.S. Cl.

CPC ..... *A47C 4/283* (2013.01); *A47C 7/62* (2013.01); *A47C 7/70* (2013.01)

(58) Field of Classification Search

None

See application file for complete search history.

(56) References Cited

U.S. PATENT DOCUMENTS

| | | | | |
|---|---|---|---|---|
| 2,837,142 | A * | 6/1958 | McGuire | A47C 4/283 297/440.11 |
| 3,331,629 | A | 7/1967 | Munson et al. | |
| 3,730,584 | A * | 5/1973 | Uchida | A47C 4/283 248/436 |
| 4,025,088 | A | 5/1977 | Rothschild | |
| 4,115,751 | A * | 9/1978 | Huizenga | H01H 37/12 337/323 |
| 4,270,795 | A | 6/1981 | Warren | |
| 4,536,027 | A * | 8/1985 | Brennan | A47C 7/70 244/122 R |
| 4,566,731 | A | 1/1986 | Marchesini | |
| 4,579,383 | A | 4/1986 | Colby | |
| 5,570,928 | A | 11/1996 | Staunton et al. | |
| 5,873,624 | A | 2/1999 | Simpson | |

(Continued)

FOREIGN PATENT DOCUMENTS

| | | | |
|---|---|---|---|
| CN | 203934898 | U | 11/2014 |
| DE | 3018912 | A1 | 11/1980 |

*Primary Examiner* — David E Allred

(74) *Attorney, Agent, or Firm* — McCormick, Paulding & Huber LLP

(57) ABSTRACT

First and second U-shaped cross-members each have legs connected by cross bars and pivotally connected with each other at central portions thereof, and are mutually movable from a generally X-shaped setup condition in which the cross bars are transversely spaced apart, to a generally flat collapsed condition. Right and left frame side assemblies respectively are pivotally connected to the first and second cross-members at terminal ends of their respective front and rear portions and by at least one lost motion linkage.

10 Claims, 6 Drawing Sheets

(56) References Cited

U.S. PATENT DOCUMENTS

| | | | | |
|---|---|---|---|---|
| 6,550,855 | B2 | 4/2003 | Liu | |
| 7,918,495 | B2 | 4/2011 | Chen | |
| 9,060,611 | B2 | 6/2015 | Grace | |
| 9,332,849 | B2 | 5/2016 | Wagner et al. | |
| 2002/0185932 | A1* | 12/2002 | Gummin | F03G 7/065 310/307 |
| 2010/0013273 | A1 | 1/2010 | Chen | |
| 2010/0171342 | A1 | 7/2010 | Chen | |
| 2011/0169304 | A1 | 7/2011 | Chen | |
| 2015/0082526 | A1 | 3/2015 | Grudzinski | |

* cited by examiner

EASY FOLDING CROSS BRACE DESIGN

CROSS-REFERENCE TO RELATED APPLICATIONS

This application is a continuation of and claims the benefit of U.S. patent application Ser. No. 15/792,020, filed Oct. 24, 2017, which is a continuation of U.S. patent application Ser. No. 14/464,318, filed Aug. 20, 2014, issued as U.S. Pat. No. 9,795,217, on Oct. 24, 2017, which claims priority to U.S. Provisional Patent Application No. 61/867,675, filed Aug. 20, 2013, all of which are incorporated herein by reference in their entireties.

TECHNICAL FIELD OF THE INVENTION

The present invention generally relates to folding furniture. Particular embodiments relate to improvements in director's chairs that are foldable and unfoldable between a set-up condition for use and a substantially collapsed condition for transportation and/or storage. Other embodiments relate to other folding furniture items, e.g., folding tables.

BACKGROUND OF THE INVENTION

Popularity of the mini van, the sport utility vehicle and the recreational vehicle has resulted in increased demand for improved collapsible furniture and particularly collapsible portable furniture of the outdoor type which may be readily stowed in a vehicle and conveniently manually transported to a picnic area or the site of a spectator event, such as, for example, an outdoor concert, a sporting event, a golf tournament, or an air show, where the general rule is to bring your own seating accommodations.

Considerable attention has been directed to the provision of improved collapsible furniture for the picnicker, sportsman, hunter, fisherman, hiker, biker and the like. However, the resulting furniture designs and particularly the designs for chairs and seats have usually incorporated some reduction in size, as compared to the full-sized article, with a corresponding reduction in the level of seating comfort. The wooden beach chairs and lawn furniture of an earlier era has generally been replaced by light-weight tubular metal furniture of a more modern design. However, little has been done to optimize the collapsibility and portability of the full-sized article, which is a goal of the present invention.

One foldable chair design available on the market is known as a director's chair. A director's chair generally comprises a chair frame that folds side-to-side with a scissors action. A conventional director's chair design is illustrated in FIG. 1 in its set-up condition and in FIG. 2 in its collapsed condition. Generally, such a chair comprises transversely spaced apart right and left frame side assemblies of mirrored design interconnected by cross-members that can be folded together to collapse the chair to a generally flat condition. The seat and back of the chair are made of canvas or a similar strong fabric which bears the user's full weight and can be collapsed with the frame. Generally, the seat and scissored cross-members work together to support and distribute the sitter's weight in a set-up chair so that the seat is comfortably taut.

Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. However, a common problem with the prior art director's chair design is that in folding the chair from a collapsed condition to a setup condition, or from the setup condition to the collapsed condition, there is a "snapping" action that can present a finger pinch. This is a result of the design of the frame, in which the frame members that support the fabric back support tend to spread apart as the chair is folded.

Spreading of the back support members stretches the fabric back support, causing the fabric to act as a spring.

In view of the foregoing, there is a need for a director's chair that can be folded between a collapsed condition and a setup condition without snapping or finger pinching. Further, there is a need for such a chair that can be folded with minimal effort, without limiting or compromising the structural features of the chair. Accordingly, it is a general object of the present invention to provide a foldable and portable director's chair design that overcomes the problems and drawbacks associated with folding director's chairs, and therefore significantly improves the utility of such a chair while permitting easy transportation and/or storage in a collapsed condition.

The present invention addresses these issues, and provides a means to circumvent the associated drawbacks of such prior art foldable chair designs.

SUMMARY OF THE INVENTION

The present invention is directed to a collapsible and portable director's chair design especially suitable for use as a beach chair, a lawn chair, and the like, where the chair can be folded from the set-up condition to a flat collapsed condition for transportation and/or storage.

In accordance with an aspect of the present invention, a collapsible and portable director's chair includes right and left frame side assemblies collectively defining forward and rear leg portions, lateral armrest portions, and a back support. The chair also includes cross-members connecting the right and left frame side assemblies and collectively defining a seat support. The cross members are pivotally connected to one another as well as to the right and left frame side assemblies to facilitate side-by-side folding of the chair frame to a collapsed condition. In a preferred design, the cross-members each comprise front and rear portions that are pivotally connected about respective central pivot points to generally assume the shape of an X when the chair is in the set-up condition and that are disposed in generally parallel relationship when the chair is folded. The chair further includes a seat panel supported by the seat support and a backrest panel supported by the back support for collectively accommodating a user seated in the chair.

In accordance with the present invention, the cross members are pivotally connected to the frame side assemblies outwardly from the front and rear surfaces of said assemblies so as to define folding clearances which facilitate folding of the chair frame to a flat collapsed condition. When so folded, the cross members are collapsed from a generally X shape associated with the set-up condition of the chair frame towards one another to a generally parallel relationship to one another. As the cross members are collapsed together, in side-by-side fashion, the frame side assemblies are brought together—maintaining a parallel relationship to one another until they are adjacent and brought within the planar footprint of the collapsed cross-members.

In particular embodiments of the invention, a first of the cross members is made wider from front to back than is the other or second of the cross members. Accordingly, when the cross members are folded, the second cross member is able to nest within the first cross member, while the frame side assemblies in turn are able to nest within the second cross-member.

As a result, the chair of the present invention is folded to a substantially flat collapsed condition that takes up less space for storage and transportation than for the prior art director's chair design illustrated in FIGS. 1-2, which is restricted during folding such that the frame side assemblies remain transversely outside of the collapsed cross-members.

In embodiments of the director's chair in accordance with the present invention, the back support may be removed from the chair frame during folding to make the collapsed bundle smaller. Alternatively, the back support can be adapted to fold in line with the armrests of the chair to reduce the size of the folded chair frame.

In embodiments of the present invention, a side tray can be attached to the chair frame and adapted for folding with the chair to its flat collapsed condition.

These and other features of the present invention are described with reference to the drawings of preferred embodiments of a collapsible and portable director's chair. The illustrated embodiments of features of the present invention are intended to illustrate, but not limit the invention.

DETAILED DESCRIPTION OF EMBODIMENTS OF THE INVENTION

Figure 3:
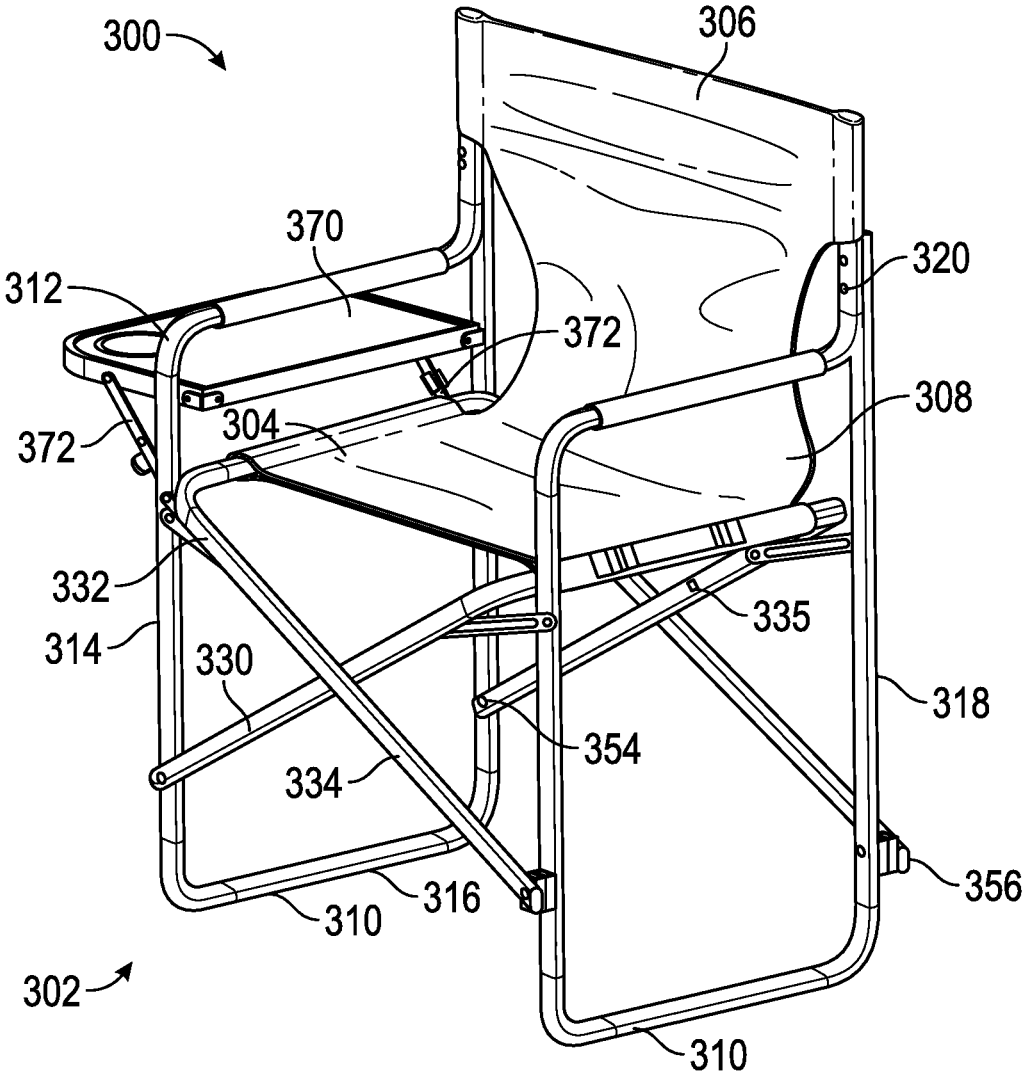
FIG. 3 is a perspective view of a collapsible and portable director's chair in accordance with an embodiment of the present invention, with the chair in a set-up condition.

In the drawings and in the description that follows the present invention is illustrated and described with reference to collapsible and portable director's chair designs embodying the present invention. A first embodiment of a director's chair 300 in accordance with the present invention is shown, for example, in FIG. 3 in a set-up condition ready for use. The chair 300 includes a frame 302 that carries a generally rectangular seat support panel 304 and a generally rectangular back support panel 306. As illustrated in FIG. 3, the seat panel and the backrest panel comprise generally flexible panels, e.g., fabric panels or plastic panels, that are connected by a flexible connector panel 308, though the panels 304, 306 can be separate pieces without departing from the spirit and principles of the present invention.

In general, the frame 302 is comprised of several frame members rigidly and/or pivotally connected together to define the chair frame and permit folding and collapsing of the frame to a condition suitable for easy transportation and storage. Preferably, the frame members are fabricated from a durable lightweight material such as a tubular metal or high-strength plastic. Various elongated structural parts or members that comprise the chair frame are preferably constructed from tubular material of non-circular cross-section, such as, for example, extruded aluminum tubing having square, oval, or elliptical cross-section, or, alternately, of circular cross-section.

Figure 4:
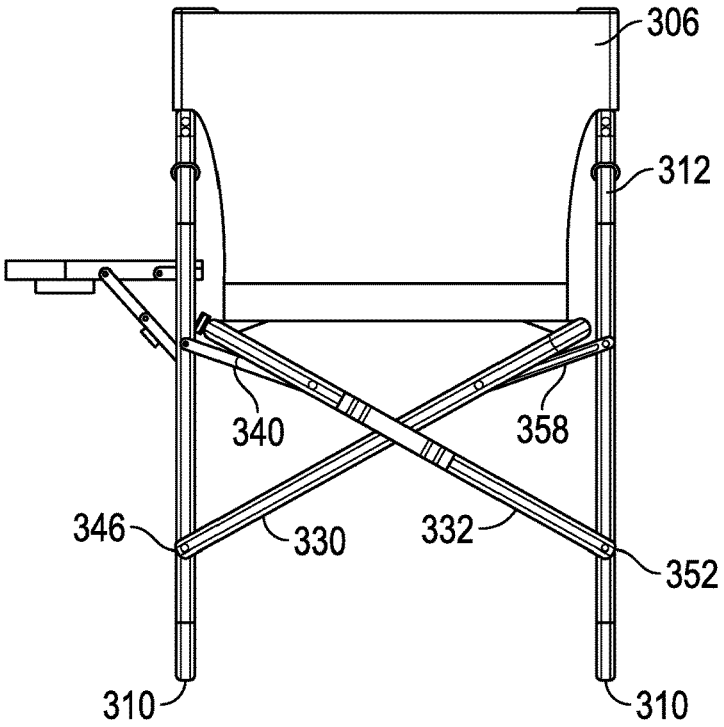
FIG. 4 is a planar front view of the director's chair of FIG. 3.
Figure 5:
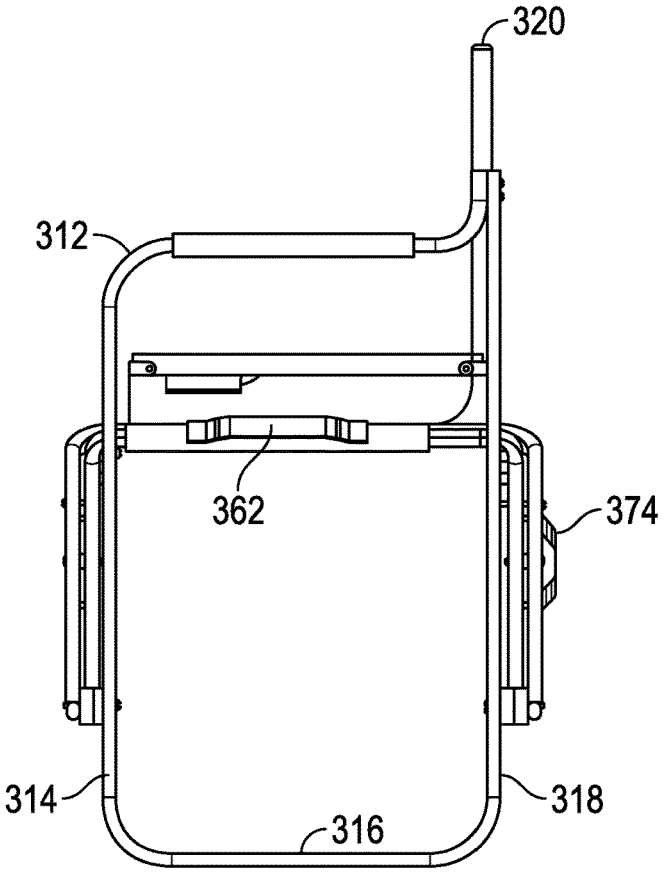
FIG. 5 is a planar side view of the director's chair of FIG. 3.
Figure 7:
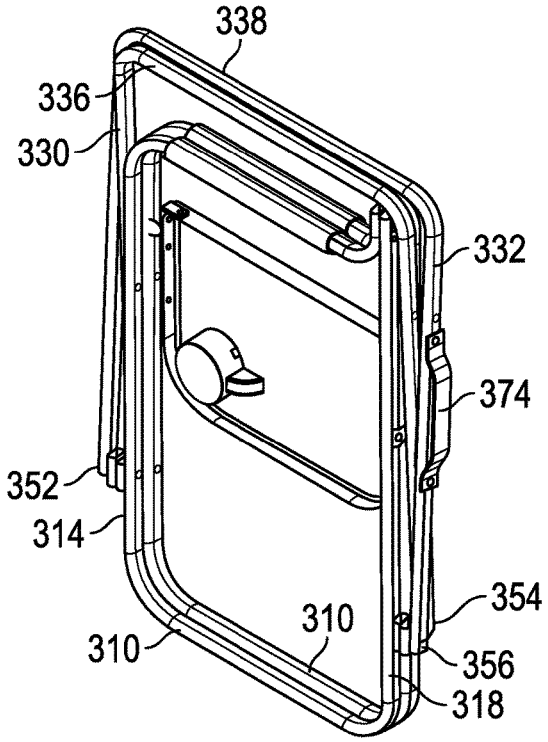
FIG. 7 is a perspective view of the director's chair of FIG. 3 folded to its collapsed condition.

Referring to FIGS. 4 and 5, the frame 302 includes a pair of side assemblies 310 that are comprised of frame members and have substantially identical, but mirrored, construction. The right and left frame side assemblies 310 are disposed in laterally or transversely spaced apart and generally parallel relation to each other when the chair is in its set-up condition. In the illustrated embodiment, the frame side assemblies are interconnected to be transversely collapsed, or folded side-to-side, to a folded condition as generally shown in FIG. 7.

Considering now one embodiment of a frame side assembly 310, as shown in FIG. 3, the side assembly includes a generally closed frame loop constructed from axially-elongated tubular material that is bent to define in counterclockwise direction a lateral armrest portion 312, a front leg portion 314, a lower ground support portion 316, and a rear leg portion 318. As shown, the frame loop meets between the armrest portion and the rear leg portion to extend upwardly from the rear leg portion. This portion, in the illustrated design, is adapted with a socket 360 to receive a back support member 320 that is removably attached to the frame side assembly 310 to support the backrest panel 306 in the set-up condition of the chair 300. As discussed below, when the chair 300 is to be folded to its collapsed condition, the back support member 306 on each side of the chair frame may be removed to reduce the size of the folded chair. In an alternate embodiment of the chair (not shown), the back support members 306 may be pivotally connected to the frame side assembly, and folded—e.g., to a position generally parallel to the armrest portion 312—when the chair 300 is to be collapsed, or unfolded during set-up of the chair.

Though illustrated as being formed from a singular tubular member, the frame side assembly may be constructed from multiple tubular members without departing from the spirit and principles of the present invention. For example, each portion of the illustrated frame loop can be a separate member, with the various frame members being interconnected by rigid or flexible joints to define the frame side assembly. Still further, the frame side assembly may be constructed from an open design instead of a closed frame loop, where the frame members are interconnected by rigid, pivotal, sliding and/or telescopic joints to effect easy folding and unfolding of the chair between a set-up and collapsed condition.

Figure 8:
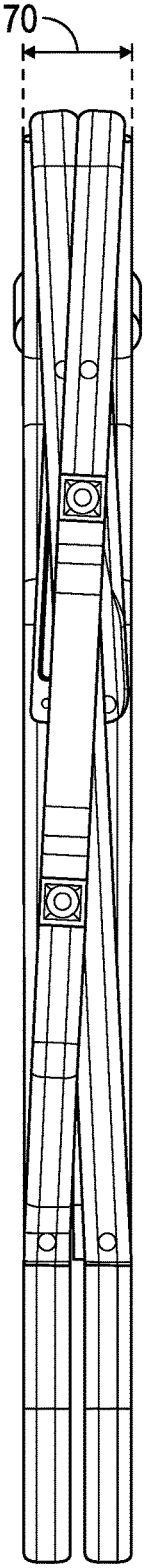
FIG. 8 is a planar front view of the folded director's chair of FIG. 7.

The frame members for the frame side assemblies 310 preferably are disposed within generally parallelly extending vertical planes. Further, the right and left frame side assemblies 310 preferably are connected each to another for transverse movement relative to each other about a centrally located pivot axis. That is, to fold the chair frame 302 to its collapsed position, the frame side assemblies 310 move towards each other until they are disposed adjacent to one another in a generally parallel relationship, as shown in FIG. 8. To setup the chair, the frame side assemblies 310 are moved away from each other until they are in the transversely spaced apart relationship generally associated with the set-up condition of the chair shown in FIG. 4. Referring more closely to FIGS. 4 and 8, the frame side assemblies 310 are connected together by a first generally U-shaped cross-member 330 and by a second generally U-shaped cross-member 332. The first cross-member 330 is pivotally attached to outward surfaces of the front leg portion 314 and the rear leg portion 318 of one of the associated frame side assemblies 310. The second cross-member 332 is pivotally attached to outward surfaces of the front leg portion 314 and the rear leg portion 318 of the other of the associated frame side assemblies 310, e.g., via offset pivot braces 340. The first cross-member 330 and the second cross-member 332 also are pivotally connected to one another at front and rear pivot points 334, 335 that are generally associated with the centrally located pivot axis of the chair frame 302. The cross-members 330, 332 are disposed in a generally parallel relationship when the chair frame 302 is folded, as shown in FIG. 8, and are disposed in a general X-shaped relationship when the chair frame is in its set-up condition, as shown in FIG. 4. In the set-up condition of the chair frame 302, respective cross-bars 336, 338 of the first and second U-shaped cross-members 330, 332 press against inner surfaces of the right and left frame side assemblies 310.

Like the members of the frame side assemblies 310, the cross members 330, 332 are generally constructed from axially-elongated tubular material that is bent to define the U-shape of the cross-members. The respective cross-bars 336, 338, most clearly illustrated in FIG. 3, extend front-to-back as seat support members for the chair. Indeed, in the set-up condition of the chair the seat panel 304 extends between these seat support portions 336, 338 of the cross-members 330, 332 to define the seat of the chair.

As can be seen, respective rear portions 342, 344 of the cross-members 330, 332 are connected between respective rear leg portions 318 of the chair frame, and are connected at a rear pivot 335 to form a pivotable rear X-frame, which opens into the shape of an "X" when the chair frame 302 is opened to its set-up condition, as shown in FIG. 3, and which collapses generally flat when the chair is folded, as shown in FIG. 7. Similarly, respective front portions 348, 350 of the cross-members 330, 332 are connected between respective front leg portions 314 of the chair frame, and likewise are connected at a front pivot 334 to form a pivotable front X-frame, which also opens into the shape of an "X" when the chair frame 302 is opened to the set-up condition, and which collapses when the chair is folded. Terminal ends of each of the front and rear portions of the cross-members 330, 332 are pivotally connected to respective portions of the chair frame. More particularly, a terminal end 346 or 352 of each front cross-member portion 348 or 350 is pivotally connected to a forward surface of a respective front leg portion 314 of a frame side assembly 310, and a terminal end 354 or 356 of each rear cross-member portion 342 or 344 is pivotally connected to a rearward surface of a respective rear leg portion 318 of a frame side assembly 310.

Additionally, pivot braces 358 are provided near upper ends of the front and rear cross-member portions 348 and 342 while offset pivot braces 340 are provided at upper ends of the front and rear cross-member portions 350, 344 so as to pivotally connect the cross-members 330, 332 to the frame side assemblies. As illustrated in FIGS. 3-4, these pivot braces 340, 358 also are connected to the forward surface of the front leg portions and rearward surface of the rear leg portions of the chair frame, for reasons discussed further below. Accordingly, the frame side assemblies 310 are joined each to the other, to enable, in part, transverse, or left-right, folding of the chair frame 302, by the pair of movable X-frame connector assemblies formed by the pivotable interconnection of the cross-members 330, 332.

The cross-members 330, 332 also provide support for the chair frame 302 in the open, set-up condition by balancing and redistributing the forces exerted on the chair frame by a person seated on the seat panel 304 and leaning back on the backrest panel 306.

Figure 1:
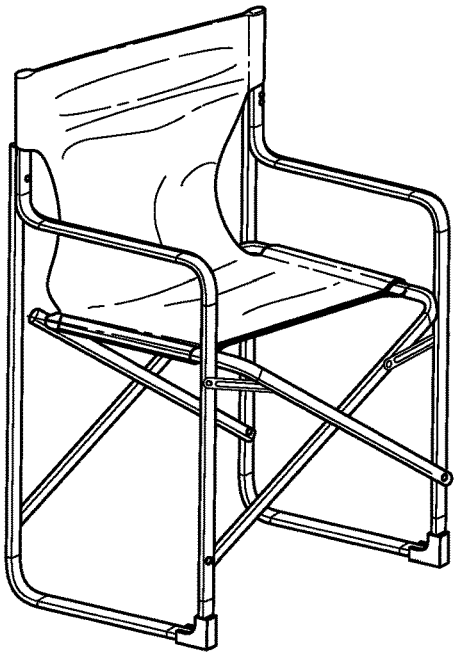
FIG. 1 (Prior Art)
FIG. 1 is a perspective view of a prior art collapsible and portable director's chair with the chair in a set-up condition.
Figure 2:
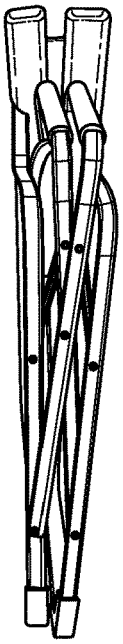
FIG. 2 (Prior Art)
FIG. 2 is a front planar view of the prior art director's chair of FIG. 1 folded to its collapsed condition.

Heretofore, an issue with the prior art director's chair design illustrated in FIG. 1, was that a folded chair, while collapsed to a near flat condition, still did not fold completely flat. As a result, the folded chair inefficiently utilized the space for storage and transportation. Notably, as shown in FIG. 2, when the exemplary prior art chair is folded to its collapsed condition, its right and left frame side assemblies remain on the outside of the collapsed cross-members to form a generally trapezoidal package. Ideally, as in the present invention, the armrest portions of the frame side assemblies should instead be adjacent to one another, and more preferably should touch in parallel fashion when the chair is folded. When the armrest portions are still transversely spaced apart, as in the prior art design, too much space is wasted for storage and/or transportation of the chair.

The director's chair 300 of the present invention addresses the drawbacks of the prior art director's chair design discussed above because the nesting U-shaped cross-members 330, 332 establish a folding recess for receiving the right and left frame side assemblies 310 within their planar footprint when the chair frame 302 is folded or collapsed. Referring to FIGS. 3 and 5, the terminal ends 346, 352, 354, 356 of the cross-members 330, 332 are pivotally connected to the forward and rearward facing surfaces of the frame side assemblies 310. As illustrated, the first U-shaped cross-member 330 comprises the front portion 348, the seat support portion 336, and the rear portion 342, all interconnected with one another to define the first cross-member. Likewise, the second U-shaped cross-member 332 comprises the front portion 350, the central seat-support portion 338, and the rear portion 344, all interconnected with one another to define the second cross-member. The front portions 348, 350 are interconnected by the front pivot 352, while the rear portions 342, 344 are interconnected by the rear pivot point 346.

Figure 9:
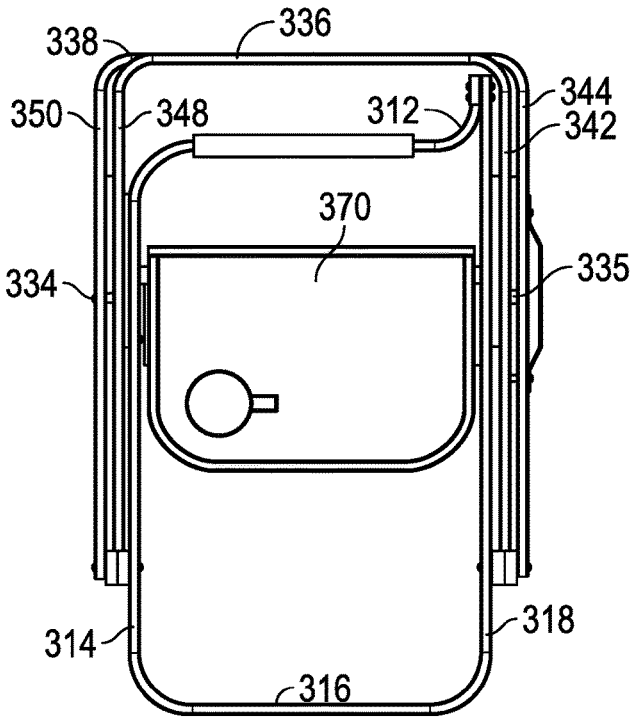
FIG. 9 is a planar side view of the folded director's chair of FIG. 7.

As shown in FIG. 3, the first front portion 348 and the first rear portion 342 are directly pivotally connected to the respective forward and rearward facing surfaces of the left frame side assembly 310, while the second front portion and the second rear portion are pivotally connected to offset pivot braces 340 that are pivotally attached to the forward and rearward facing surfaces of the right frame side assembly 310. When the cross-members 330, 332 are folded to their generally parallel collapsed condition, the first cross-member 330 is nested within the second cross-member 332, with respective front portions, cross bars, and rear portions being adjacent to one another, as illustrated in FIGS. 8-9. Further, the positioning of the cross-members on the outwardly facing surfaces of the frame members, coupled with the addition of the offset pivot braces 340 so as not to interfere with folding movement of the cross-member 330 into the cross member 332, defines a planar footprint or envelope 70 within the folded cross-members into which the frame side assemblies can be positioned when transversely folded together.

In order to alleviate a risk of finger-pinching during movement of the cross-members 330, 332 between the setup condition and the collapsed condition of the chair frame 302, one or more lost motion linkages (e.g., a slotted link 337) may be provided to connect the cross-members with the frame side assemblies 310.

Figure 10:
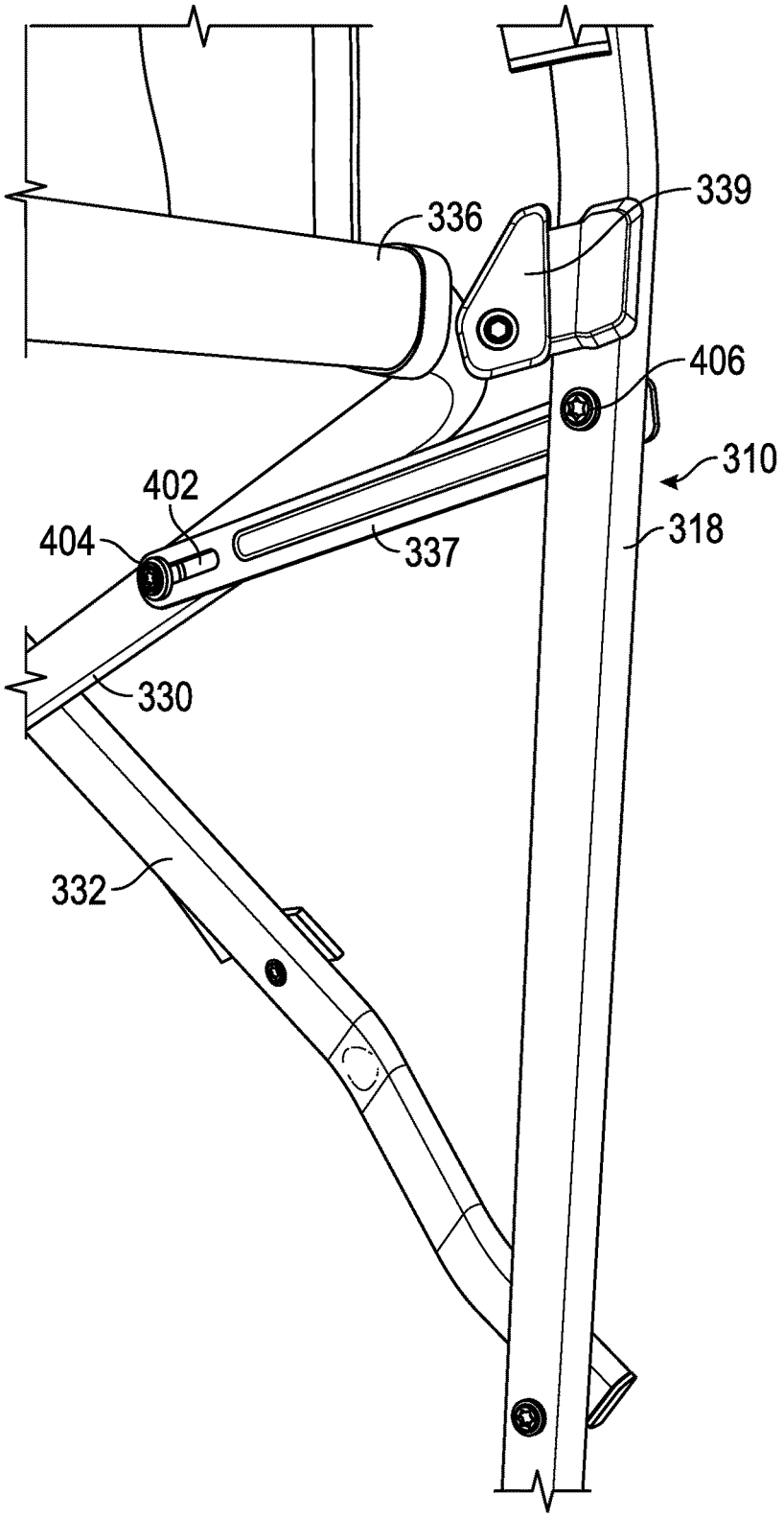
FIG. 10 shows in perspective view a slotted pivot link of the chair shown in FIGS. 3-9 in accordance with the present invention.

Referring specifically to FIG. 10, one of the one or more slotted links 337 has a slot 402 in its lower (inward) end, which connects to a pin 404 at the forward (inward) surface of the rear portion of the first cross-member 330. Thus, the flat link 337 pivotally connects to the cross-member 330 at its lower left end, while the flat link 337 has its right end pivotally connected by a pin 406 at the rear (outward) surface of the rear leg portion 318 of the vertical frame side assembly 310. Also shown in FIG. 10 is a snubber 339, which is attached near the top of the rear leg portion 318 of the vertical frame side assembly 310, and presses against the rearward corner of the cross-bar of the cross-member 330.

As a result of the slot 402, folding action of the cross-members 330, 332 does not tend to spread the back support members 320 or to stretch the backrest panel 306. Instead, the slot 402 permits the slotted link 337 to slidingly relax an outward force imposed by the cross-member 330 against the right frame side assembly 310 (which relaxation makes the slotted link 337 a part of a lost motion linkage between the cross-member 330 and the right frame side assembly 310). Additionally, the snubber 339 prevents the cross-member 330 and the link 337 from traveling over-center in a snapping fashion. Thus, the inventive lost motion linkage prevents or mitigates a risk of fingers being caught in the folding motion of the chair or other apparatus so configured.

Figure 6:
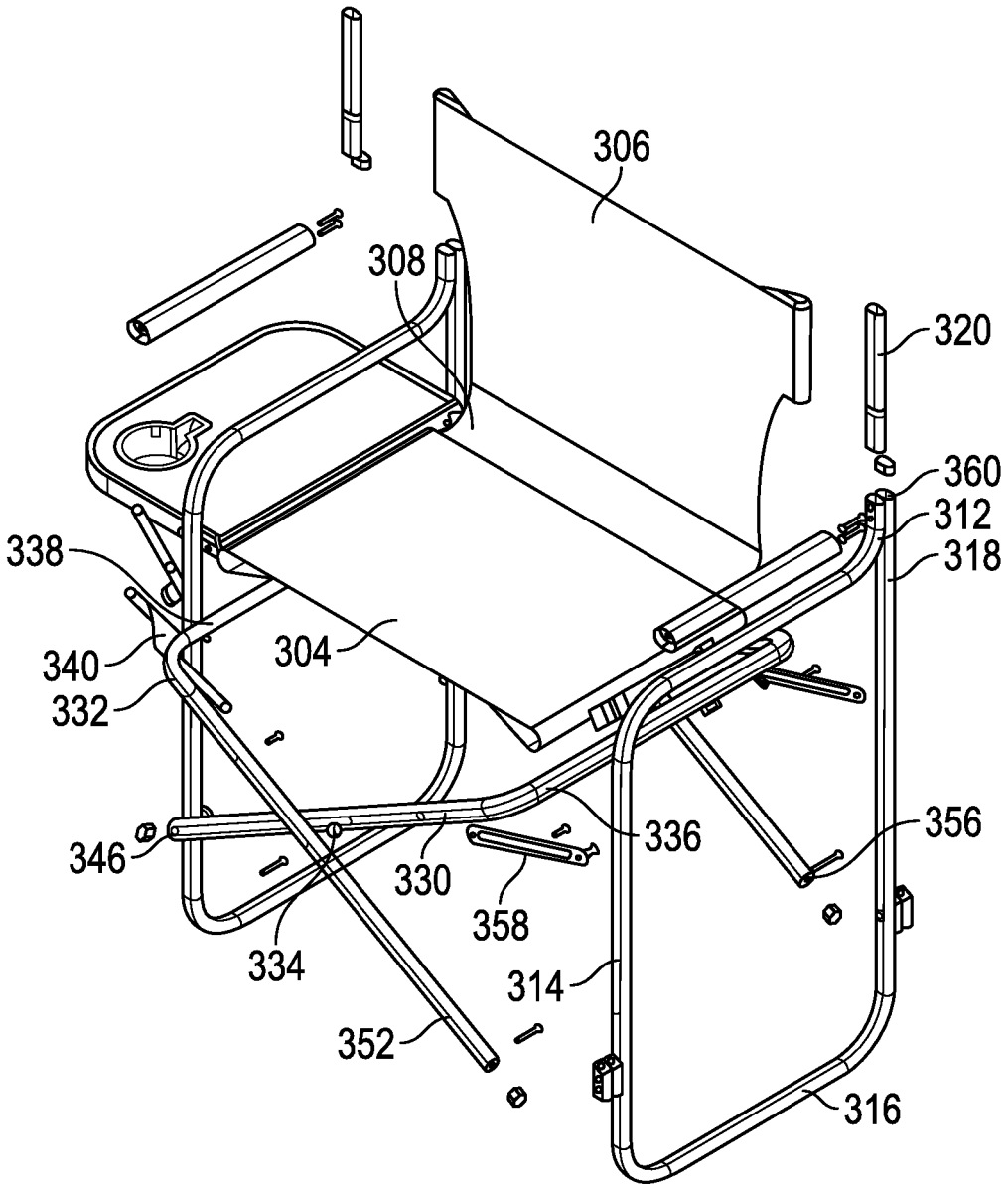
FIG. 6 is a partially exploded perspective view of the director's chair of FIG. 3.

The chair frame 302 is generally adapted to rest on a generally horizontally oriented supporting surface, such as a floor or the ground, in a set-up condition. In the set-up condition, the flexible seat panel 304 defines a generally taut chair seat support and the flexible backrest panel 306 defines a generally taut chair back support, for collectively accommodating an upright, seated chair occupant. The seat panel 304 and the backrest panel 306 are secured to portions 336, 338 of the chair frame that help define and provide the seat support and the back support for the occupant. As shown, the back support members 320 are preferably mounted relative to the rear leg portions to extend upward therefrom. In the embodiment illustrated in FIG. 3, the back support members 320 are adapted to be removed from the chair frame 302 prior to folding. Referring to FIG. 6, each of the back support members 320 can be inserted into a socket 360 of a respective frame side assembly 310 during set-up. When removed from their sockets 360, the back support members 320 preferably are contained by the backrest panel 306, and are folded into the chair frame 302 as it is collapsed. In an alternate design, the back support members may be pivotally attached to the frame side assemblies, and folded—preferably to a position generally parallel with the armrest portions—to collapse the chair.

Referring again to the embodiment illustrated in FIG. 3, when the chair is folded up for transportation and/or storage, the user simply presses together the frame side assemblies 310 toward each other, which causes the cross-members 330, 332 to pivot relative to each other about their front and back pivot connections 334, 335, from the X-shape associated with the set-up condition of the chair to positions whereby the cross-members are disposed generally parallel to each other, as shown in FIG. 7. As the cross-members 330, 332 pivot relative to one another about the central pivot points 334, 335, the frame side assemblies 310 move together within their parallel planes to form the flat collapsed condition of the chair 300. To set-up the chair, the user simply pulls outwardly on each frame side assembly 310 until the cross-members 330, 332 pivot to the desired X-shaped conditions.

In an alternate approach for collapsing the chair shown in FIG. 3, the seat panel 304 has a handle 362 at one or both sides of the frame 302. Generally, each of the handles is provided along the portion of the seat panel 302 that encloses one of the cross-members 330 or 332, preferably on the cross bar 336 or 338 outside the seat fabric, to facilitate folding and set-up of the chair, as shown in FIGS. 3 and 5. To fold up the chair, a user pulls up on one of the handles 362 that is mounted to the seat, while simultaneously holding firmly on the armrest portion 312 of the frame side assembly 310 that is adjacent to the handle 362 when the chair is in the set-up condition. When tautness and rigidity of the seat panel is desired or required for comfortable use of the chair, folding of the chair in a standard way—i.e., by pressing on the chair frame members to effect folding and collapsing of the chair frame—may be difficult. Use of a handle, such as described above, makes the folding process less difficult. The lost motion linkage 337 also is of great assistance in reducing the force required for collapsing or setting up the chair frame 302. The handle or handles 362 may be particularly useful in case the cross-members 330, 332 are configured to frictionally lock against the front and rear leg portions 312, 318 of the frame side assemblies 310, or against the snubber 339, in which case, the chair frame 302 cannot be collapsed simply by pushing together the frame side assemblies 310.

In accordance with preferred embodiments of the present invention, the seat and backrest panels 304, 306 may be made from fabric or other suitable flexible, durable and weather resistant sheet material. In accordance with preferable designs of the chair, the panels 304, 306 are flexible to accommodate the seated user, thereby improving the comfort level of the chair. In the set-up condition of the chair, the seat panel 304 and the backrest panel 306 extend between the frame side assemblies 310 and are generally taut for supporting a seated user. When the chair 300 is collapsed to a folded condition, such as shown in FIG. 7, the panels 304, 306 become flaccid and fold within the collapsed condition of the chair. The seat panel 304 preferably provides a 17-inch seat height for the chair when in a set-up condition for use, though the frame design of the present invention can be used with chair designs requiring a higher or lower seat height without departing from the spirit and principles of the present invention. The backrest panel 306 preferably provides a high profile capable of supporting the user's upper back, neck and head, though various dimensions for the backrest panel may be used without affecting operation of the chair in accordance with the present invention. Indeed, the present invention also works with a chair design not requiring any back support.

Referring to FIG. 3, the chair 300 may also include a tray 370 that is pivotally attached to the chair frame 302. As illustrated, the tray 370 is attached to the left frame side assembly 310, and is supported and can be locked in a use position, by front and back over-center linkages 372 as generally known in the art. The tray 370 can be folded down into parallel relationship with the left frame side assembly 310 when not needed or for folding the chair 300 to its collapsed condition. As shown in FIGS. 7-9, the tray 370 folds within the footprint of the left frame side assembly 310 and is accordingly contained within the folded bundle of the chair 300 without expanding the size and space utilized by the collapsed chair.

Referring to FIGS. 7 and 9, a carrying handle 374 may also be provided on the chair frame 302 to facilitate carrying of the collapsed chair. As illustrated, one such handle is provided on the rear portion of the second cross-member 332, and is only exposed when the chair is folded to its collapsed condition. Alternatively, one of the handles 362 may be used as a carrying handle.

As noted, the present invention can be used for all types of apparatus incorporating cross members that fold side-to-side with a scissors action. For example, the director's chair 300, as shown herein can be adjusted to different heights without compromising operation of the present invention. Similarly, the present invention can be adapted for an event chair requiring a shorter set-up height than a typical director's chair or for a bar stool requiring a higher set-up height than a typical director's chair, or for a table or other furniture. Regardless of the chair height or the length of the cross-members to accommodate and actually define such heights in addition to defining the seating surface of the chair, the fundamentals of operation of the chair frame 302 remain the same as described herein such that the collapsed chair can position both frame side assemblies 310 and both cross-members 330, 332 within a generally common plane or rectangular package.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. An apparatus comprising:

first and second U-shaped cross-members, each of said cross-members including a front portion, a rear portion, and a cross bar perpendicularly connecting the front portion to the rear portion, wherein the respective front portions of the first and second cross-members are pivotally connected with each other at central portions thereof and the respective rear portions of said cross-members are pivotally connected with each other at central portions thereof, wherein the cross-members are mutually movable from a generally X-shaped set-up condition in which the cross bars of the first and second cross-members are transversely spaced apart, to a generally flat collapsed condition in which the cross bars of the first and second cross-members are generally adjacent one another; and right and left frame side assemblies are pivotally connected to each of the first and second cross-members, wherein at least one of the right and left frame side assemblies is pivotally connected to one of the first and second cross-members by a lost motion linkage;

wherein said lost motion linkage comprises a longitudinal link having a first end pivotally connected to one of the first and second cross-members via a first pivot pin and a second end pivotally connected to the at least one of the right and left frame side assemblies via a second pivot pin, said longitudinal link further comprising a slot extending partially along a length of the link proximate at least one of the first end and the second end and in which the first pivot pin or the second pivot pin is received for sliding movement within said slot with movement of the cross-members between the set-up condition and the collapsed condition.

2. The apparatus according to claim 1, wherein each of the right and left side frame assemblies is connected to a respective one of the first and second cross-members by a lost motion linkage.

3. The apparatus according to claim 1, wherein when the cross-members are moved to their collapsed condition the right and left frame side assemblies are transversely moved to positions adjacent to one another.

4. The apparatus according to claim 1, further comprising at least one snubber attached at one of the right and left frame side assemblies for frictionally locking at least one of the cross-member into its setup condition.

5. The apparatus according to claim 4, wherein the snubber prevents the at least one cross-member from travelling over-center when moving said at least one cross-member to its set-up condition.

6. The apparatus according to claim 4, wherein the snubber is positioned on the rear leg portion of one of the right and left frame assemblies for interaction with a rearward corner of the at least one cross-member with which it interacts.

7. The apparatus according to claim 6, wherein the snubber projects inwardly from the frame side assembly to which it is attached towards the other frame side assembly.

8. The apparatus according to claim 1, wherein the at least one lost motion linkage is attached to the rear portion of one of the first and second cross-members and a rear portion of the frame side assembly adjacent to the one of the first and second cross-members when said cross members are in the set-up condition.

9. The apparatus according to claim 8, wherein the at least one lost motion linkage is attached to the forward surface of the rear portion of one of the first and second cross-members and a rear surface of the rear portion of the corresponding frame side assembly to which the lost motion linkage is attached.

10. The apparatus according to claim 1, further comprising a seat panel attached at the cross bars of the first and second cross-members, which is taut across the cross bars in the set-up condition of the cross-members, and is flaccid in the collapsed condition of the cross-members.

* * * * *